US005533460A

United States Patent [19]

Tseng

[11] Patent Number: 5,533,460

[45] Date of Patent: Jul. 9, 1996

[54] THREAD TENSION DEVICE WITH LATCH FOR A SEWING MACHINE

[76] Inventor: Hsien-Chang Tseng, 9th Floor, No. 13-4, Sec. 1, Da Ching Street, Taichung, Taiwan

[21] Appl. No.: 542,171

[22] Filed: Oct. 12, 1995

[51] Int. Cl.[6] ..... D05B 47/02

[52] U.S. Cl. ..... 112/254

[58] Field of Search ..... 112/254, 255; 242/147 R, 149

[56] References Cited

U.S. PATENT DOCUMENTS

| | | | |
|---|---|---|---|
| 3,150,846 | 9/1964 | Laidig | 112/254 X R |
| 5,156,105 | 10/1992 | Wang | 112/254 |
| 5,191,847 | 3/1993 | Kojima et al. | 112/254 |
| 5,211,122 | 5/1993 | Lin | 112/254 |

FOREIGN PATENT DOCUMENTS

| | | | |
|---|---|---|---|
| 488745 | 1/1954 | Italy | 112/254 |

*Primary Examiner*—Ismael Izaguirre
*Attorney, Agent, or Firm*—Connolly & Hutz

[57] ABSTRACT

A thread tension device includes a pair of discs engaged on a shaft and a spring for biasing the discs to clamp a thread. A follower is threadedly engaged on the shaft for adjusting the spring. A barrel is engaged with the follower so as to rotate the follower. A cap is rotatably engaged on the barrel. A latch is slidably engaged in the barrel for engaging the barrel with the cap so as to allow the barrel and the cap to rotate in concert when the latch is engaged with the cap. The barrel is allowed to rotate freely relative to the cap when the latch is disengaged from the cap.

8 Claims, 2 Drawing Sheets

THREAD TENSION DEVICE WITH LATCH FOR A SEWING MACHINE

BACKGROUND OF THE INVENTION (a) Field of the Invention

The present invention relates to a tension device, and more particularly to a thread tension device for a sewing machine.

(b) Description of the Prior Art

A typical thread tension device is disclosed in U.S. Pat. No. 5,211,122 to Lin and comprises a dial for rotating a follower so as to adjust the biasing force of a spring. However, the dial is engaged within a knob such that the dial should be rotated by a special tool and such that the dial may not be easily operated.

The present invention has arisen to mitigate and/or obviate the afore-described disadvantages of the conventional thread tension devices.

SUMMARY OF THE INVENTION

The primary objective of the present invention is to provide a thread tension device in which the thread tension can be adjusted easily.

In accordance with one aspect of the present invention, there is provided a thread tension device for a sewing machine, the thread tension device comprises a support for securing to the sewing machine, the support including a shaft extended therefrom and having an outer thread formed thereon, a pair of discs engaged on the shaft for clamping a thread therebetween, means for biasing the discs toward each other so as to clamp the thread in place, a follower threadedly engaging with the outer thread of the shaft so as to allow the follower to move along the shaft when the follower rotates relative to the shaft, a barrel rotatably engaged on the shaft and including a rib means for engaging with the follower so as to rotate the follower when the barrel is rotated, the barrel including an outer peripheral portion having a slot formed therein, a cap rotatably engaged on the barrel, and a latch means slidably engaged in the slot of the barrel for engaging the barrel with the cap so as to allow the barrel and the cap to rotate in concert when the latch means is engaged with the cap. The barrel is allowed to rotate freely relative to the cap when the latch means is disengaged from the cap.

The slot includes a shoulder means formed therein, the latch means includes a pair of resilient legs each having a hook means for engaging with the shoulder means so as to secure the latch means to the barrel.

The barrel includes a first end having an annular flange formed thereon, the latch means includes a knob flushing with the annular flange.

The knob of the latch means includes a hole formed therein for engaging with a tip member so as to move the latch means along the slot.

The cap includes an inner peripheral portion having a plurality of protrusions formed therein so as to form a plurality of grooves therebetween, the latch means includes a bulge for engaging with the grooves so as to allow the barrel and the cap to rotate in concert with each other when the latch means is moved toward the cap.

The cap includes a projection extended therefrom, the thread tension device further comprises a board secured to the shaft and having an extension extended therefrom for engaging with the projection of the cap so as to limit a rotational movement of the cap relative to the shaft.

The support includes a pin extended therefrom, the discs each includes a depression formed therein for engaging with the pin so as to prevent the discs from rotating relative to the shaft.

The discs include a first disc engaged with the support and include a second disc engaged with the first disc and distal to the support, the second disc includes a recess formed therein, the biasing means includes a spring engaged on the shaft for biasing the discs toward each other, the spring includes a first end engaged with the recess of the second disc so as to be prevented from rotating relative to the discs.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
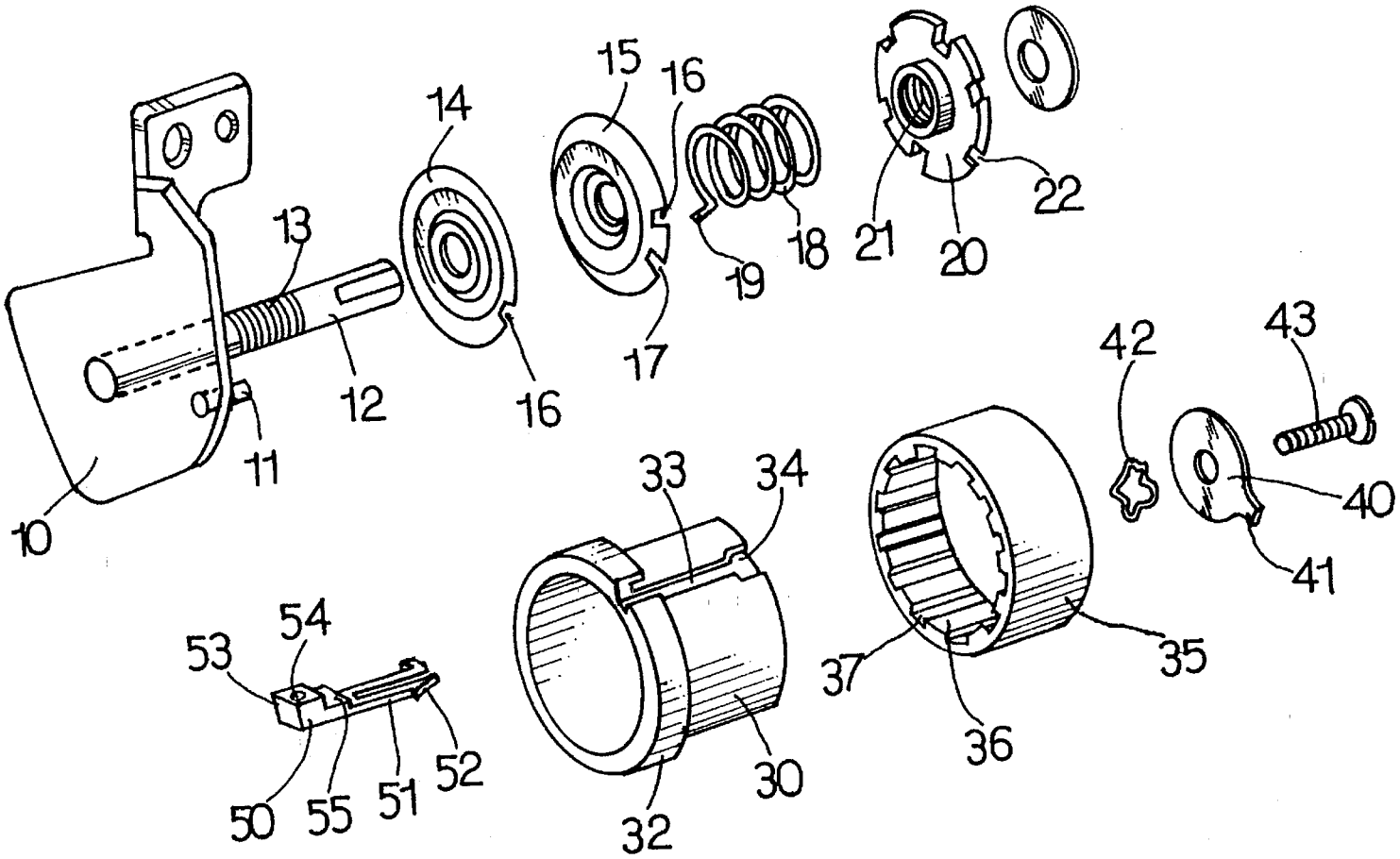
FIG. 1 is an exploded view of a thread tension device in accordance with the present invention.
Figure 2:
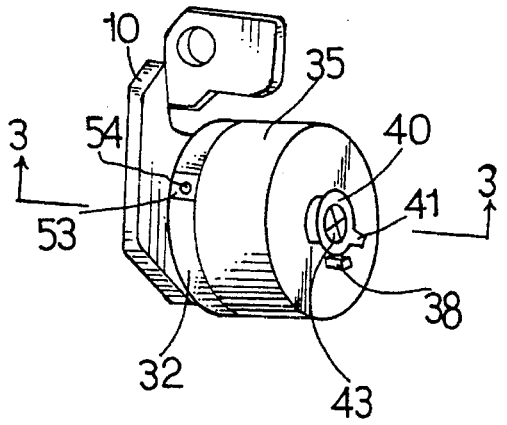
FIG. 2 is a perspective view of the thread tension device.
Figure 3:
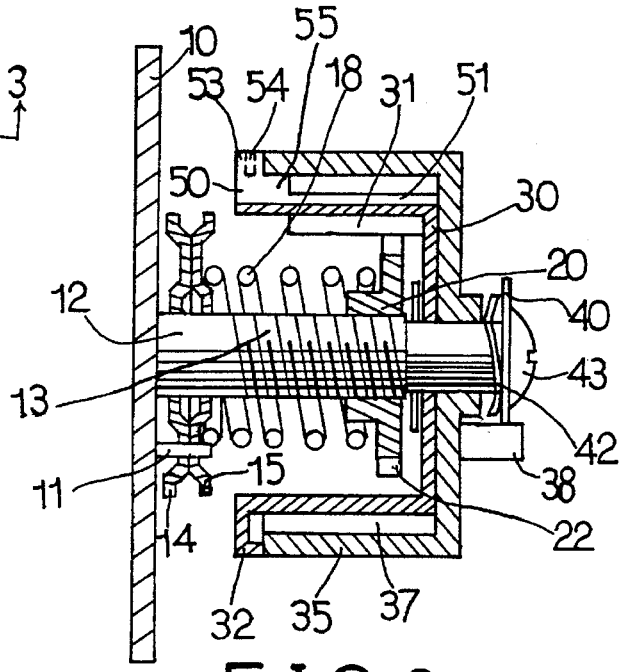
FIGS. 3 and 4 are cross sectional views taken along lines 3—3 of FIG. 2.

Referring to the drawings, and initially to FIGS. 1 to 3, a thread tension device in accordance with the present invention comprises a support 10 for securing to an upper portion of a sewing machine. The support 10 includes a pin 11 and a shaft 12 extended therefrom. The shaft 12 includes an outer thread 13 formed on the middle portion thereof. Two discs 14, 15 are engaged on the shaft 12 for clamping a thread therebetween, and each includes a depression 16 formed therein for engaging with the pin 11 such that the discs 14, 15 can be prevented from rotating relative to the shaft 12. The disc 15 which is located further to the support 10 includes a recess 17 therein. A spring 18 is engaged on the shaft 12 for biasing the discs 14, 15 toward each other so as to clamp the thread in place. The spring 18 includes an end portion 19 engaged in the recess 17 such that the spring is prevented from rotating relative to the disc 15. A follower 20 includes an inner thread 21 for engaging with the outer thread 13 of the shaft 12 such that the follower 20 may be moved along the shaft 12 so as to adjust the biasing force of the spring 18 when the follower 20 is rotated relative to the shaft 12. The follower 20 includes a number of notches 22 formed in the outer peripheral portion.

A barrel 30 is rotatably engaged on the shaft 12 and includes a rib 31 (FIG. 3) longitudinally formed in the inner portion for engaging with either of the notches 22 so as to rotate the follower 20 when the barrel 30 is rotated relative to the shaft 12. The barrel 30 includes an annular flange 32 formed on one end thereof and located close to the support 10, and includes a slot 33 formed in the outer peripheral portion thereof. The slot 33 includes a shoulder 34 formed in one end distal to the annular flange 32. A cap 35 is rotatably engaged on the barrel 30 and includes a number of protrusions 36 so as to form a number of grooves 37 therebetween. The cap 35 includes a projection 38 (FIG. 2) extended therefrom. A board 40 is secured to the shaft 12 by a fastening screw 43 and includes an extension 41 extended therefrom for engaging with the projection 38 such that the cap 35 is limited to rotate relative to the shaft 12 for one circle only. A spring washer 42 is engaged between the shaft 12 and the board 40.

A latch device 50 is slidably engaged in the slot 33 and includes a pair of resilient legs 51 each having a hook 52 formed in the end portion for engaging with the shoulder 34 of the slot 33 so as to secure the latch device 50 to the barrel 30. The latch device 50 includes a knob 53 flushing with the annular flange 32 of the barrel 30, best shown in FIGS. 2 and 3. The knob 53 includes a hole 54 formed therein for engaging with a tip member, such as the tip of a pen or of a toothpick, which may be provided for moving the latch device 50 along the slot 33. The latch device 50 includes a bulge 55 formed in the middle portion for engaging with either of the grooves 37 of the cap 35 when the latch device 50 is moved toward the cap 35, best shown in FIGS. 3 and 4.

In operation, when the latch device 50 is moved toward the cap 35 so as to engage the bulge 55 with one of the grooves 37, as shown in FIGS. 2 and 3, the barrel 30 and the cap 35 are engaged with each other by the projection 55 such that the barrel 30 and the cap 35 rotate in concert. At this moment, the cap 35 is limited to rotate for about 360 degrees only such that the follower 20 may also be rotated for about 360 degrees only. At this moment, the barrel 30 may not be rotated relative to the cap 35.

Figure 4:
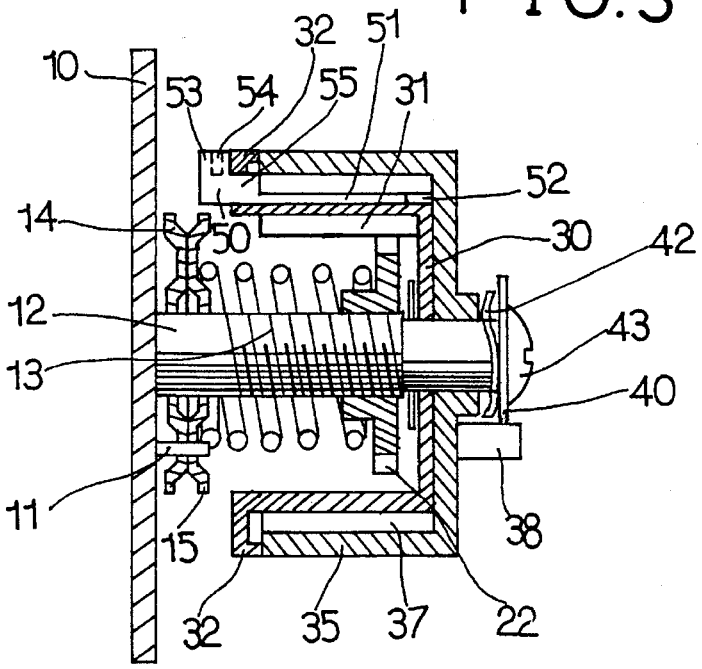

As shown in FIG. 4, when the latch device 50 is moved away from the cap 35 so as to disengage the bulge 55 from the grooves 37 of the cap 35, the barrel 30 may be freely rotated relative to the cap 35 such that the follower 20 may be rotated freely along the shaft 12 in order to adjust the biasing force of the spring 18.

It is to be noted that the barrel 30 is designed to be rotated by the manufacturers in a quality control process before the products may be sold and is not supposed to be rotated by the users. Without the barrel 30, the manufacturers have to disassemble the elements in order to adjust the spring and may usually have to disassemble the elements for many times. In addition, the latch device 50 is designed so as not to be rotated by the users easily. However, the operators may easily move the latch device 50. It is only required to move the latch device 50 for about 2 to 3 mm in order to allow the free rotation of the barrel 30.

Accordingly, the thread tension device in accordance with the present invention may be easily adjusted to suitable thread tension by the operators.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A thread tension device for a sewing machine comprising:

a support for securing to the sewing machine, said support including a shaft extended therefrom and having an outer thread formed thereon, a pair of discs engaged on said shaft for clamping a thread therebetween, means for biasing said discs toward each other so as to clamp the thread in place, a follower threadedly engaging with said outer thread of said shaft so as to allow said follower to move along said shaft when said follower rotates relative to said shaft, a barrel rotatably engaged on said shaft and including a rib means for engaging with said follower so as to rotate said follower when said barrel is rotated, said barrel including an outer peripheral portion having a slot formed therein, a cap rotatably engaged on said barrel, and a latch means slidably engaged in said slot of said barrel for engaging said barrel with said cap so as to allow said barrel and said cap to rotate in concert when said latch means is engaged with said cap, said barrel being allowed to rotate freely relative to said cap when said latch means is disengaged from said cap.

2. A thread tension device according to claim 1, wherein said slot includes a shoulder means formed therein, said latch means includes a pair of resilient legs each having a hook means for engaging with said shoulder means so as to secure said latch means to said barrel.

3. A thread tension device according to claim 1, wherein said barrel includes a first end having an annular flange formed thereon, said latch means includes a knob flush with said annular flange.

4. A thread tension device according to claim 3, wherein said knob of said latch means includes a hole formed therein.

5. A thread tension device according to claim 1, wherein said cap includes an inner peripheral portion having a plurality of protrusions formed therein so as to form a plurality of grooves therebetween, said latch means includes a bulge for engaging with said grooves so as to allow said barrel and said cap to rotate in concert with each other when said latch means is moved toward said cap.

6. A thread tension device according to claim 1, wherein said cap includes a projection extended therefrom, said thread tension device further comprises a board secured to said shaft and having an extension extended therefrom for engaging with said projection of said cap so as to limit a rotational movement of said cap relative to said shaft.

7. A thread tension device according to claim 1, wherein said support includes a pin extended therefrom, said discs each includes a depression formed therein for engaging with said pin so as to prevent said discs from rotating relative to said shaft.

8. A thread tension device according to claim 1, wherein said discs include a first disc engaged with said support and include a second disc engaged with said first disc and distal to said support, said second disc includes a recess formed therein, said biasing means includes a spring engaged on said shaft for biasing said discs toward each other, said spring includes a first end engaged with said recess of said second disc so as to be prevented from rotating relative to said discs.

* * * * *